US007288055B2

(12) United States Patent
Blaum

(10) Patent No.: US 7,288,055 B2
(45) Date of Patent: Oct. 30, 2007

(54) EXERCISE AND BALANCE APPARATUS

(76) Inventor: Erik C. Blaum, 807 Apt. 1 Grand Central Ave., Lavallette, NJ (US) 08735

( * ) Notice: Subject to any disclaimer, the term of this patent is extended or adjusted under 35 U.S.C. 154(b) by 35 days.

(21) Appl. No.: 11/365,455

(22) Filed: Mar. 2, 2006

(65) Prior Publication Data

US 2007/0207906 A1 Sep. 6, 2007

(51) Int. Cl.
*A63B 26/00* (2006.01)

(52) U.S. Cl. ..... 482/142; 482/146

(58) Field of Classification Search ..... 482/142, 482/146–7, 34; 446/220
See application file for complete search history.

(56) References Cited

U.S. PATENT DOCUMENTS 3,659,844 A * 5/1972 Cummins ..... 482/130
2003/0109365 A1* 6/2003 Smith ..... 482/146

* cited by examiner

*Primary Examiner*—Lori Amerson
(74) *Attorney, Agent, or Firm*—Clifford G. Frayne

(57) ABSTRACT

A balance and exercise apparatus comprising a base member supported on an underlying stratum, pivoting member positioned on a base member, and a body support member positioned on top of the pivot member, the body support member secured to the base member by a combination of a plurality of resilient tension cords and non-resilient cinch strap thus allowing the user to either stand, lie or sit on the body support member and cause the body support member to selectively tilt from a horizontal plane about 360 degrees of orientation.

13 Claims, 8 Drawing Sheets

EXERCISE AND BALANCE APPARATUS

BACKGROUND OF THE INVENTION

1. Field of the Invention

The present invention relates to exercise and rehabilitation equipment, and more specifically, the present invention relates to a balance board which can be utilized for exercise, physical therapy, rehabilitation, and strengthening of the leg, foot, ankle, knee, hip, and abdominal muscles and their associated joints.

2. Description of the Prior Art

Balance boards have been used and disclosed in the prior art for both exercise and amusement. The elements of a balance board comprise a rigid platform and a rounded base upon which the rigid platform is mounted, the person utilizing the balance board manipulates the board by use of his legs and by the shifting of his weight in order to tilt and balance the rigid platform about the rounded base, maintaining balance and not contacting the underlying stratum.

When the rounded base is cylindrical in cross section, the user is limited in balancing in a vertical plane with the rigid platform being tiltable at opposing ends thereof in 180 degree relationship. When the rounded base is hemi-spherical in cross section, see U.S. Pat. No. 6,019,712, the user is able to tilt the rigid platform in a horizontal plane of 360 degrees.

Applicant has developed a balance board which is tiltable in a plane of 360 degrees, but which provides variable dynamic resistance about the 360 degrees and which requires the user to utilize the muscles of the lower torso and legs to maintain the balance, thus exercising and strengthening the muscles and joints, as well as providing rehabilitation therapy where required.

OBJECTS OF THE INVENTION

An object of the present invention is to provide for a novel balance and exercise board which provides the user with 360 degrees of horizontal tilt.

A still further object of the present invention is to provide a novel balance and exercise board which applies variable dynamic resistance to the board about its 360 degrees of tilt.

A still further object of the present invention is to provide for a novel balance and exercise board which can simulate the sport of surfing.

A still further object of the present invention is to provide for a novel balance and exercise board which can simulate the sport of snow boarding.

A still further object of the present invention is to provide for a novel balance and exercise board which can be used for erect balance and exercise.

Another object of the present invention is to provide for a novel balance and exercise board which can be utilized for supine exercises.

Another object of the present invention is to provide for a novel balance and exercise board which can be utilized for prone exercises.

Another object of the present invention is to provide for a novel balance and exercise board which can be utilized for sitting exercises.

A still further object of the present invention is to provide for a novel balance and exercise board which can provide for variable resistance.

SUMMARY OF THE INVENTION

A balance and exercise apparatus comprising a base member supported on an underlying stratum, pivoting member positioned on a base member, and a body support member positioned on top of the pivot member, the body support member secured to the base member by a combination of a plurality of resilient tension cords and non-resilient cinch straps thus allowing the user to either stand, lie or sit on the body support member and cause the body support member to selectively tilt from a horizontal plane about 360 degrees of orientation.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
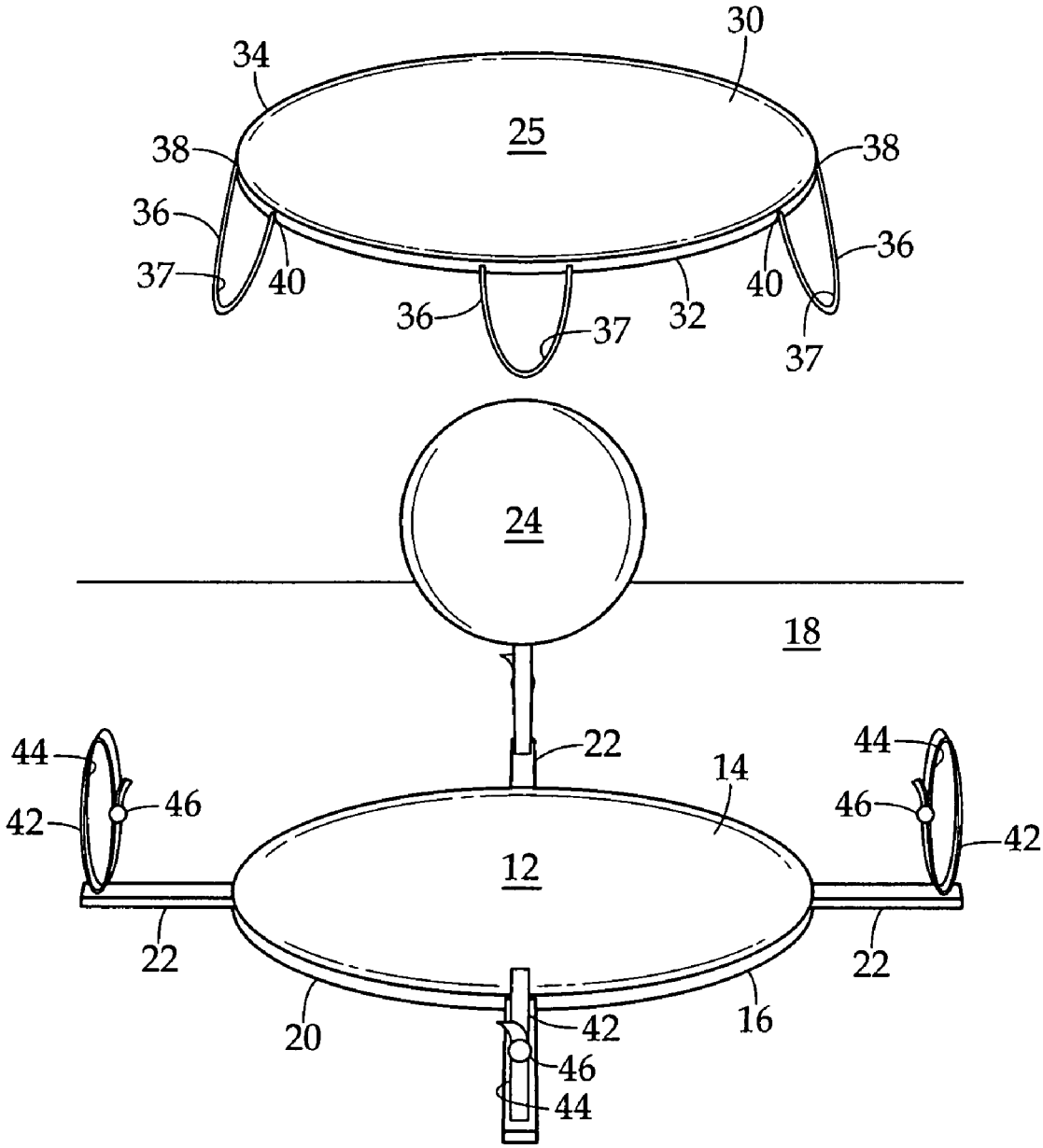
FIG. 1 is an exploded perspective view of the balance and exercise apparatus of the present invention.
Figure 2:
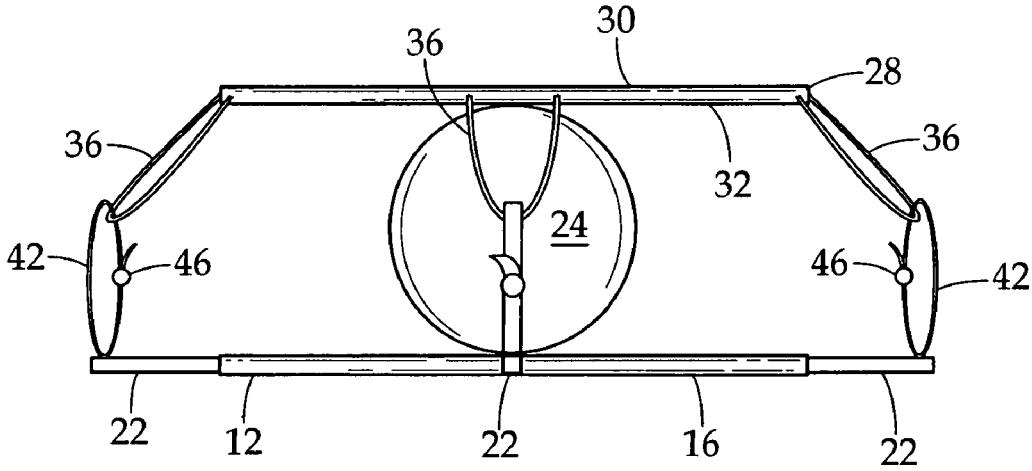
FIG. 2 is a side view of the balance and exercise apparatus of the present invention.

The balance and exercise apparatus of the present invention 10, in its essential form as illustrated in FIGS. 1 and 2, comprises a planar base member 12 having an upper surface 14 and a lower surface 16, the base member 12 designed to be positioned on a supporting stratum 18. As illustrated in FIG. 1, the base member 12 has an arcuate periphery 20, but could be formed in alternative geometric shapes. Base member 12 could be formed of wood or from a suitable thermoplastic.

Secured to base member 12 are a plurality of extension arms 22 which are in the same plane as base member 12, extension arms 22 being in approximate 90 degree relationship with each other and in communication with the substratum upon which base member 12 rests. Positioned on the upper surface 14 of base member 12 is a pivot member 24 which in the preferred embodiment is a sphere or ball 26.

Positioned on top of sphere or ball 26 is the user support platform 28. User support platform 28 is planar, having an upper surface 30 and a lower surface 32. User support platform 28 is preferably formed with an arcuate periphery 34 to avoid sharp edges or corners. As such, the user support platform 28 may be circular, oblong, ovate, or boogey board shaped.

User support platform 28 sits atop sphere or ball 26 such that the sphere or ball 26 is centrally disposed under the user support platform 28. The user support platform 28 further still is of such a size to allow an individual to stand on it or to lie in a prone or supine position or sit on the upper surface 30 of user support platform 28.

Secured to user support platform 28 and positioned in 90 degree relationship about the arcuate periphery 34 are resilient tension cords 36. Resilient tension cords 36 are formed into loops 37 by having their first end 38 and second end 40 secured to the user support platform 28 by any suitable means. The resilient tension cords 36 are secured to the user support platform about the arcuate periphery 34 or to the upper or lower surface 30 and 12 so as to be in alignment with the extension arms 22 extending outwardly from base member 12.

Secured distal proximate the ends of the extension arms 22, are non-resilient cinch straps 42. Non-resilient cinch straps 42 are secured to the distal ends of the extension arms 22 and are formed into a loop 44, each cinch strap having a friction cinch buckle 46 allowing the user to set the size of the loop 44 formed by each cinch strap 42 (See FIG. 3).

Figure 3:
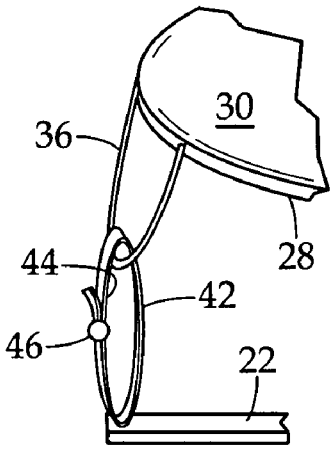
FIG. 3 is a close up view of one embodiment of the tensioning and securing means.

As illustrated in FIGS. 2 and 3, the loops 37 formed by each of the resilient tension cords 36 is secured within the loop 44 formed by the cinch straps 42, and the cinch straps are tightened so as to firmly secure the user support platform 28 atop the sphere or ball 26. Tightening in this configuration, the resilient tension cords 36 assume a V-shape. Sphere or ball 26 is preferably gaseously inflated but could also be liquid filled or gel filled as long as it assumes a spherical shape and is somewhat compressed by the user support platform 28 and the weight thereon. For purposes of examination and clarity we will hereafter refer to sphere or ball 26 as inflatable.

Figure 7:
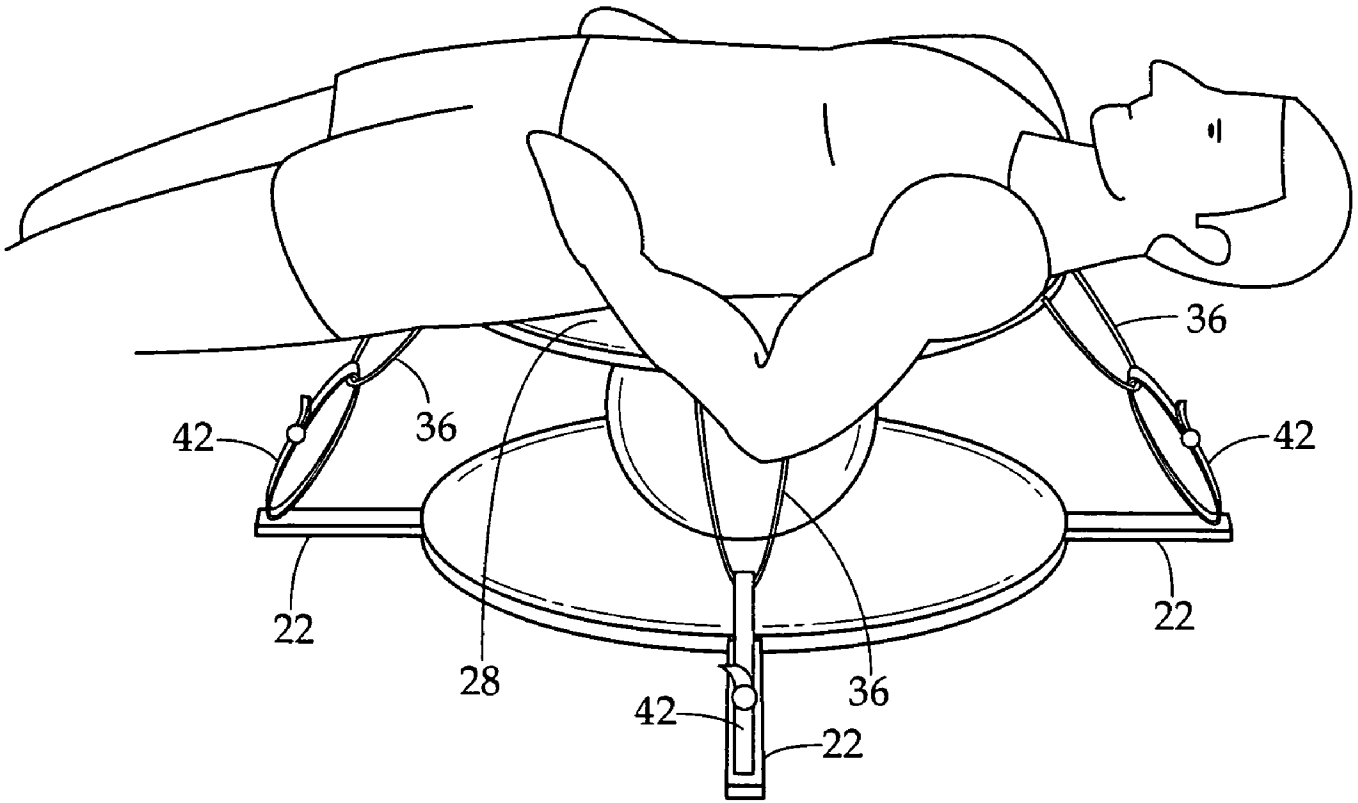
FIG. 7 is a partial perspective view of the balance and exercise apparatus of FIG. 5 being utilized by a user in a supine orientation.
Figure 8:
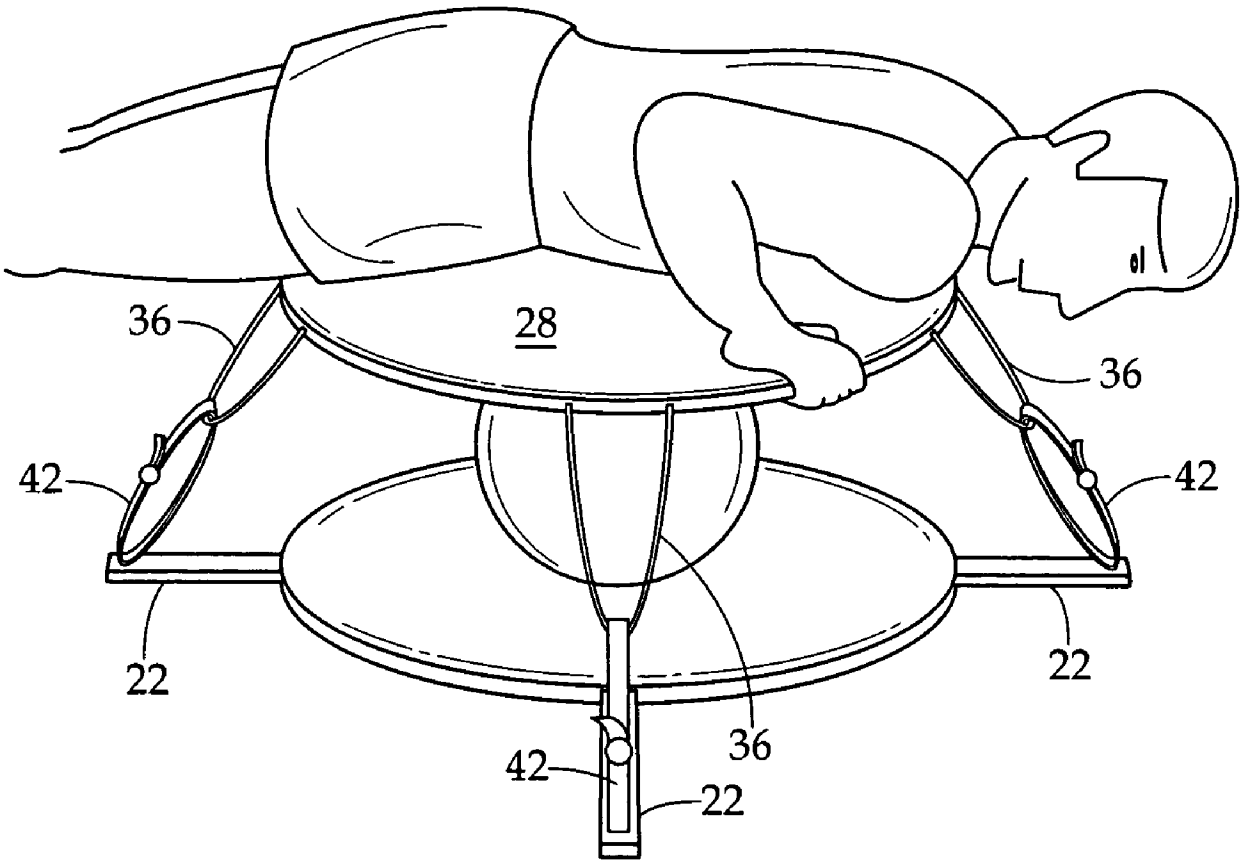
FIG. 8 is a partial perspective view of the balance and exercise apparatus of FIG. 5 being utilized by a user in a prone orientation.
Figure 9:
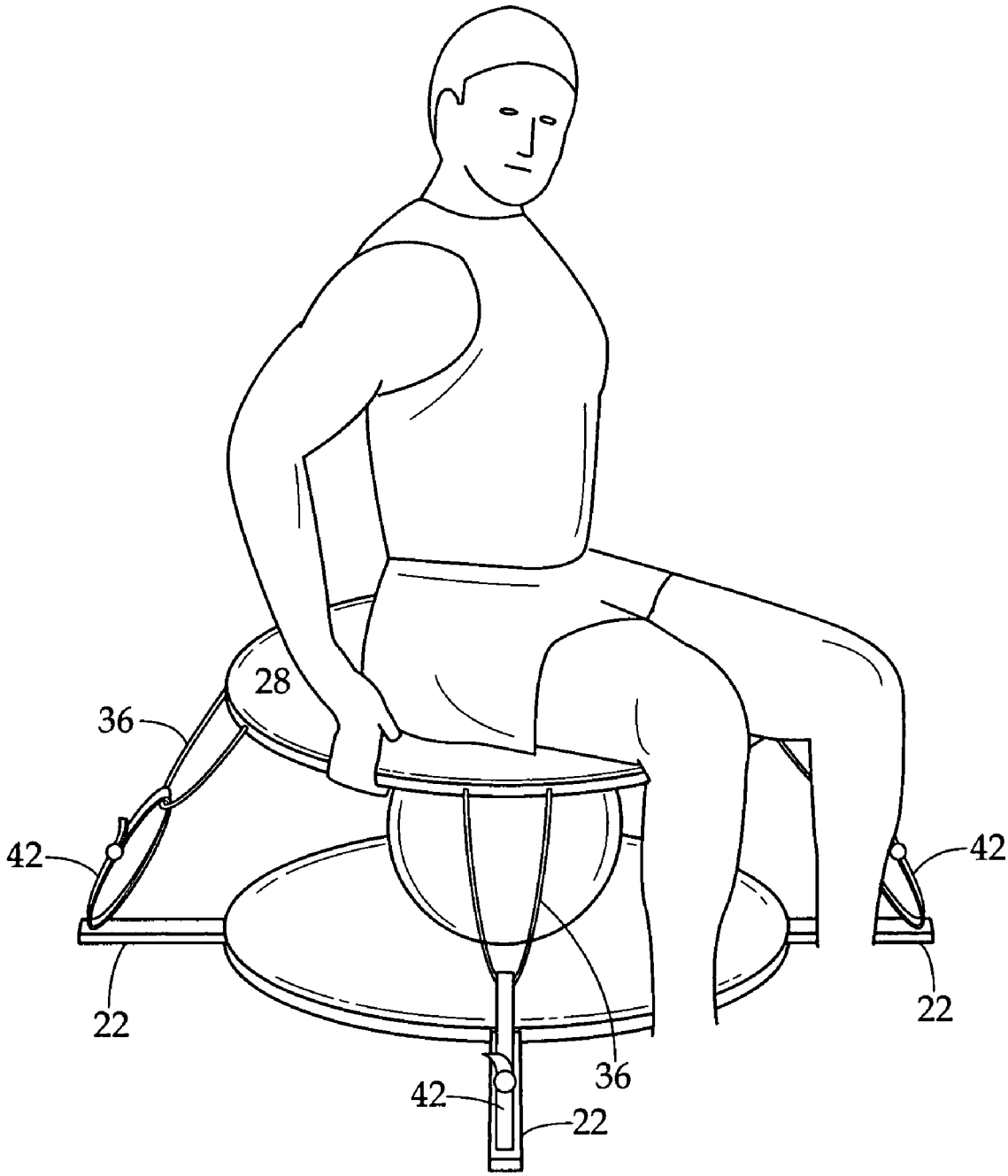
FIG. 9 is a partial perspective view of the balance and exercise apparatus of FIG. 5 being utilized by a user in a sitting position.

In this configuration as illustrated in FIGS. 6, 7, 8 and 9 the user can mount the user support platform 28 in an erect mode, and perform balance exercises for either physical exercise, physical therapy, or rehabilitation. As illustrated in FIGS. 7 and 8, the user can also mount the user support platform 28 in either a torso prone or torso supine position by gripping the peripheral edge 34 to further provide balance exercises for either physical therapy, physical exercise or rehabilitation. The user may also sit on the user support platform 28 and exercise as illustrated in FIG. 9. In either of the balance exercises illustrated in FIGS. 6, 7, 8 and 9, the inflatable sphere or ball 26 does not rotate significantly, but rather is compressed by the weight of the user on the user support platform 28 and the adjustment of the cinch straps 42 and resilient tension cords 36. As the user moves about or shifts weight on the user support platform 28, the inflatable sphere or ball 26 is slightly deformed allowing the user to shift weight in a 360 degree orientation about the user support platform 28. The simplest analogy to the manner in which the user support platform 28 is allowed to tilt in a 360 degree orientation above the inflated sphere or ball 26 is to imagine the motion mimicking that of a surf board rider. The user can stand on the user support platform 28 with feet apart and shift weight forward and backward and from side to side and the user support platform 28 will react to this weight shift by tilting in the direction of the weight shift with the tilt limited by the corresponding opposing resilient tension cords 36 and cinch straps 42.

Figure 4:
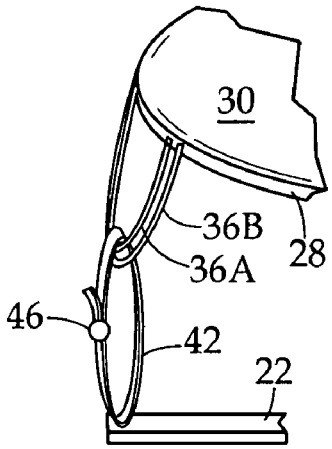
FIG. 4 is a close up view of a second embodiment of the tensioning and securing means.

While FIGS. 1, 2, 3, 6, 7, 8, and 9 illustrate the balance and exercise apparatus 10 of the present invention with a single resilient tension cord 36 at each 90 degree point about the periphery of the user support platform 28, additional resilient tension cords could be positioned at each of the 90 degree coordinates. FIG. 4 illustrates one possible embodiment of such multiple resilient tension cords 36 wherein two resilient tension cords 36A and 36B are secured proximate to the user support platform 28, each of the resilient tension cords 36A and 36B being of different lengths, but still forming a V-shaped loop 37 which could be engaged with the cinch strap 42 and adjusted by means of the cinch buckle 46. The cinch strap itself would be secured to the extension arm 22 in a suitable manner distal proximate the end of the extension arm 22.

Figure 5:
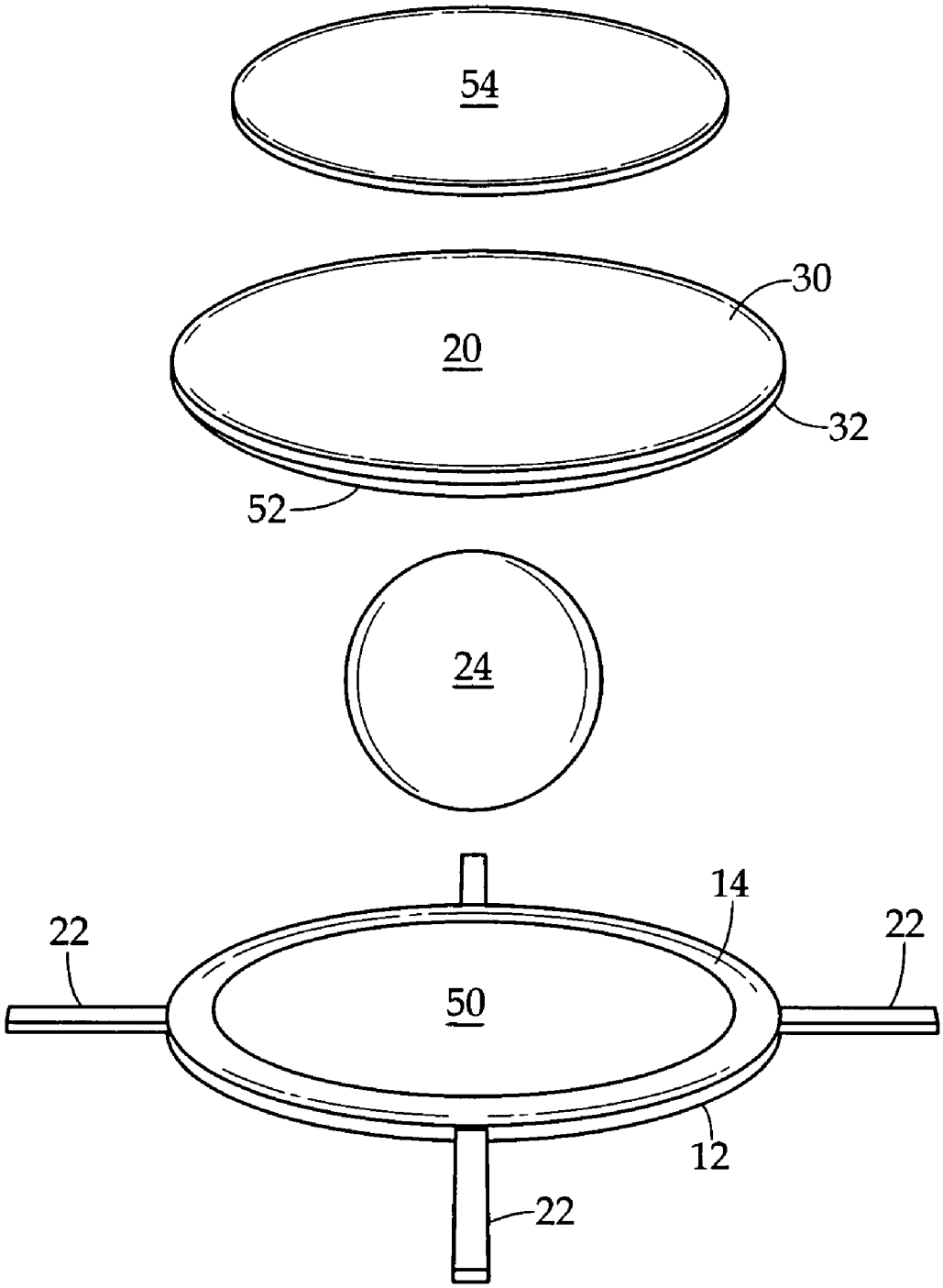
FIG. 5 is an exploded perspective view of a preferred embodiment of the balance and exercise apparatus.
Figure 6:
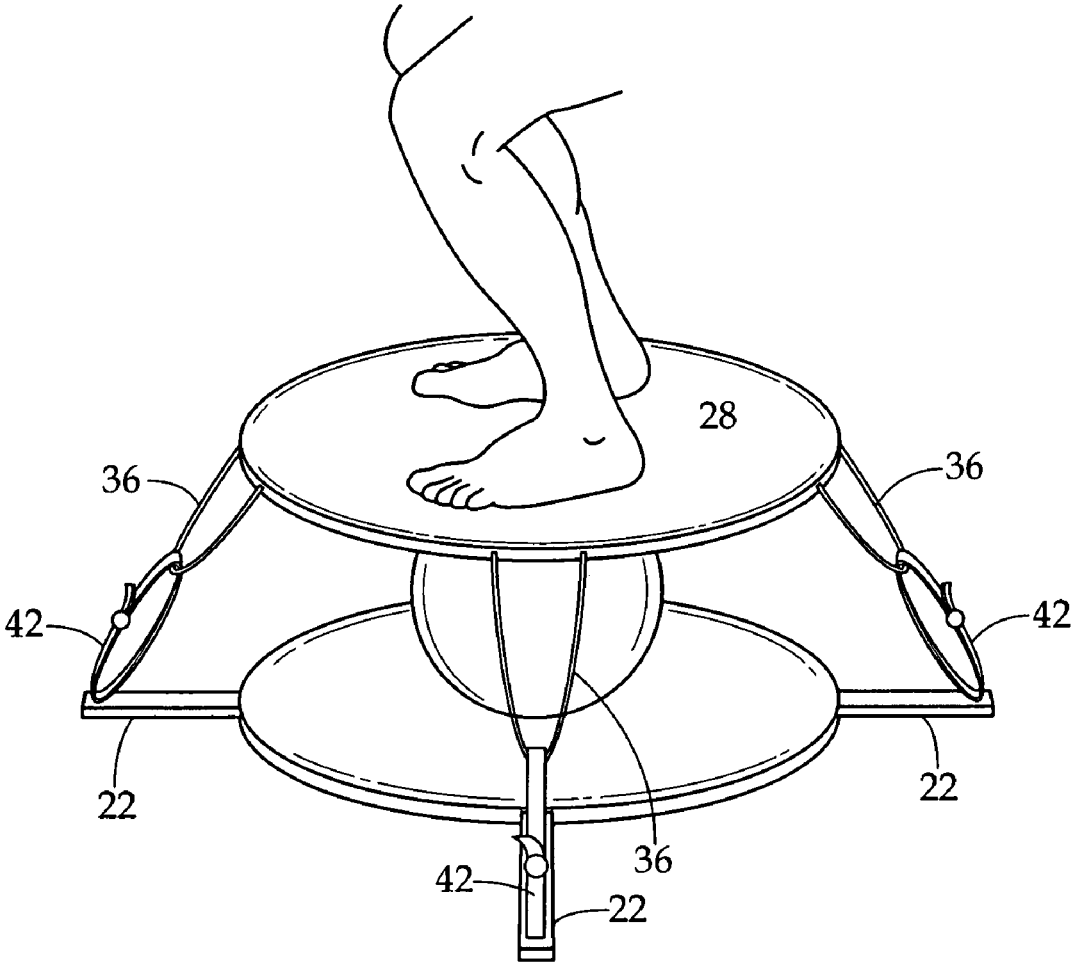
FIG. 6 is a partial perspective view of the balance and exercise apparatus of FIG. 5 being utilized by a user in an erect orientation.

FIG. 5 illustrates a preferred embodiment of the present invention which does not depart from the structure and function as illustrated in FIGS. 1, 2, 6, 7, 8, and 9, but adds additional features for comfort of the user and for extending the life of the balance and exercise apparatus 10. In FIG. 5, the upper surface 14 of base member 12 would be overlaid with a thin layer of foam or rubber-like material 50. Similarly, the underside 32 of user support platform 28 would be at least partially overlaid with a similar resilient foam or rubberized layer 52 so as to provide for a cushion surface where contact with the inflatable sphere or ball 26 occurs. This would provide for a better gripping surface with respect to contact with the inflatable sphere or ball 26, and would eliminate any possibility of an abrading surface which could effect the life span of the inflatable sphere or ball 26. Finally, the upper surface 30 of user support platform 28 may be overlaid with a similar resilient foam or rubberized material 54 for improving the grip when the user is utilizing the balance and exercise apparatus 10 in an erect position and providing additional comfort when the user is using the balance and exercise apparatus in a prone, supine, or sitting position. The tension cords and cinch straps 36 and 42 are not illustrated in FIG. 5, but would be secured in a fashion as previously discussed.

In assembly and construction of the balance and exercise apparatus, the size of the base member and the user support platform 12 and 28 will vary depending upon the size of the inflatable sphere or ball 26 utilized. Applicant has constructed and assembled an balance and exercise apparatus 10 in accordance with the present invention in which the inflatable sphere or ball 26 was an inflatable exercise ball of approximately 2 feet in diameter. As such, the user support platform 28 was constructed and dimensioned so as to extend outwardly approximately 6 inches beyond the circumference of the inflatable sphere or ball 26. The base member and extension arms 12 and 22, were constructed such that when the resilient tension cords 36 and concomitant cinch straps 42 about the periphery of the user support platform 28 were tightened, the resilient tension cords 36 formed an obtuse angle with the lower surface 32 of the user support platform 28 and the cinch straps 42 formed an acute angle with the extension arms 22. It will be recognized by one of ordinary skill in the art that if a smaller inflatable sphere or ball 26 is utilized in the apparatus as thus described, the concomitant size of the user support platform 28, base member and extension arms 12 and 22, would be reduced in order to still achieve the appropriate 360 degree tilt of the user support platform 28 while maintaining the required tension utilizing resilient tension cords 36 and non-resilient cinch straps 42 of smaller size. A sphere or ball

Figure 10:
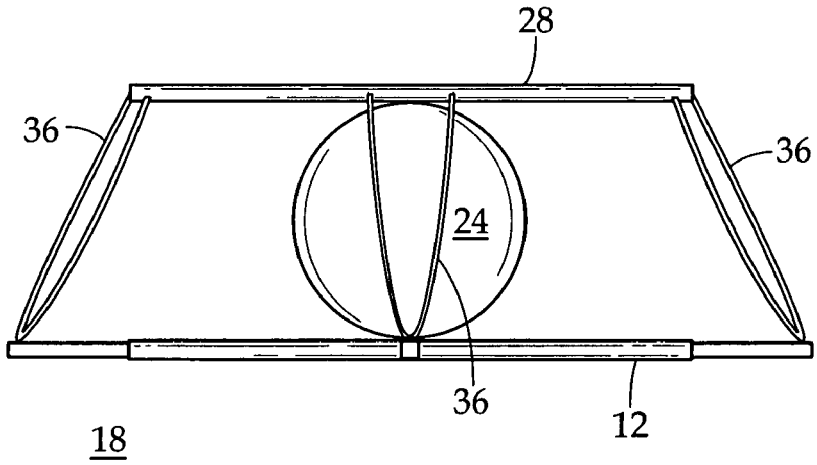
FIG. 10 is a side view of the balance and exercise apparatus of the present invention utilizing a down sized pivot point and resilient tension cords only.

26 size of smaller circumference may result in a user support platform of significantly smaller size adaptable to an area to receive the feet of the user in an erect orientation and the need for cinch straps may be obviated and resilient tension cords may be disposed between the user support platform 28 and extension arms 22 as heretofore described and illustrated in FIG. 10.

Figure 11:
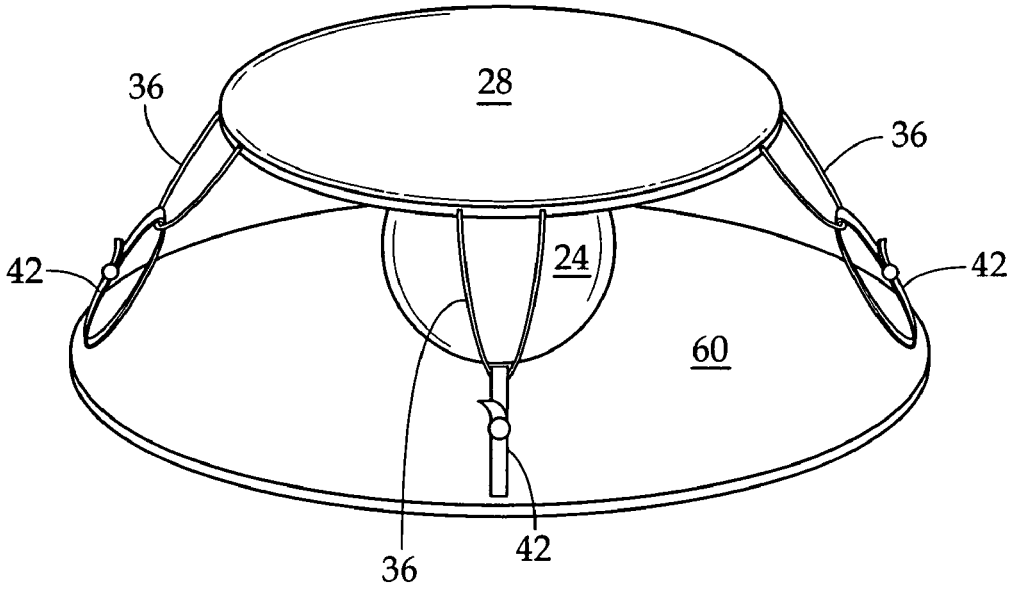
FIG. 11 is a perspective view of the balance and exercise apparatus of the present invention illustrating a second embodiment of the base member.

The preferred embodiments of the balance and exercise assembly of the present invention as illustrated in FIGS. 1 through 10 utilize a base member with a plurality of radially extending arms so as to form a base which extends sufficiently to prevent the balance and exercise apparatus of from tilting or overturning during use. The use of the radially extending arms reduces the weight of the apparatus and lends a degree of portability to the movement of the balance and exercise apparatus. It will be understood by those of ordinary skill in the art that if a more permanent type of balance and exercise apparatus of the type disclosed herein were sought to be installed, the base member could be of one piece construction with no radially extending arms, but of a sufficient area to allow the positioning of the tension cords and cinch straps as heretofore described and be of a sufficient area so as to guard against the tilting or tipping of the balance and exercise apparatus when used. FIG. 11 illustrates the balance and exercise apparatus 10 of the present invention with such a modified base member 60.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. A balancing and exercise apparatus comprising:

a rigid base member having an upper surface and a lower surface, said lower surface in contact with a support stratum;

a pivot member positioned on said base member, said pivot member being an inflatable sphere;

a rigid planar support platform having an upper surface and a lower surface positioned atop said pivot member with said lower surface contacting said pivot member, said rigid support platform dimensioned to extend beyond the dimension of said pivot member, but less than a dimension of said base member; and a plurality of resilient securing means secured to said rigid planar support platform and secured distal proximate a periphery of said rigid base member so as to permit the tilting of said planar rigid support platform about said pivot member.

2. The balancing and exercise apparatus in accordance with claim 1 wherein said rigid base member comprises a centrally disposed core member having radially extending arm members in the same plane as said core member and in contact with said support stratum, said radially extending arm members extending beyond the periphery of said rigid planar support platform.

3. The balancing and exercise apparatus in accordance with claim 1 wherein said inflatable sphere is gaseous inflated.

4. The balancing and exercise apparatus in accordance with claim 1 wherein said inflatable sphere is liquid inflated.

5. The balancing and exercise apparatus in accordance with claim 1 wherein said inflatable sphere is gel inflated.

6. The balancing and exercise apparatus in accordance with claim 1 wherein said plurality of resilient securing means comprises resilient tension cords.

7. The balancing and exercise apparatus in accordance with claim 1 wherein said plurality of resilient securing means comprises in combination, a resilient tension cord having a first end and a second end, said first end and said second end of said resilient tension cords secured to said rigid planar support platform forming a loop, and a cinch strap having a cinch buckle, said cinch strap secured proximate a distal end of said planar radially extending arm member and forming a loop, cooperable with said loop of said resilient tension cords, said cinch buckle allowing a user to adjust tension on each of said plurality of said resilient tension cords.

8. The balancing and exercise apparatus in accordance with claim 1 wherein said planar radially extending arm members are in 90 degree planar relationship with said adjacent radially extending arm members.

9. The balancing and exercise apparatus in accordance with claim 1 wherein a resilient foam layer is formed on said upper surface of said base member.

10. The balancing and exercise apparatus in accordance with claim 1 wherein a resilient foam layer is formed on said lower surface of said rigid planar support platform.

11. The balancing and exercise apparatus in accordance with claim 1 wherein a resilient foam layer is formed on said upper surface of said rigid planar support platform.

12. The balancing and exercise apparatus in accordance with claim 3 wherein said resilient securing means form an obtuse angle with said rigid planar support platform and an acute angle with said radially extending arm member when secured thereto.

13. The balancing and exercise apparatus in accordance with claim 1 wherein said rigid support member is dimensioned to support in tilting relationship with said pivot member a user on said rigid planar support platform in an erect, prone, supine or sitting position for the performance of exercises and balancing exercises.

* * * * *